United States Patent [19]

Luff et al.

[11] 4,236,599

[45] Dec. 2, 1980

[54] STOOLS

[75] Inventors: Brian A. Luff; Ronald P. Hickman, both of Jersey, Channel Islands

[73] Assignee: Inventec Licensing BV, Lomboklaan, Netherlands

[21] Appl. No.: 964,357

[22] Filed: Nov. 28, 1978

[30] Foreign Application Priority Data

Nov. 28, 1977 [GB] United Kingdom ..... 49477/77

[51] Int. Cl.[3] ..... A47C 13/00; B25M 1/00

[52] U.S. Cl. ..... 182/33; 182/129; 182/153; 144/286 R; 269/901; 269/244

[58] Field of Search ..... 182/33, 33.1, 33.2, 182/33.3, 33.4, 33.5, 33.6, 20, 129, 153; 144/286 R; 269/244, 139, 88; D25/67

[56] References Cited

U.S. PATENT DOCUMENTS

| | | | |
|---|---|---|---|
| 1,827,418 | 10/1931 | Brown | 182/33 |
| 3,397,757 | 8/1968 | Greer | 182/33.5 |
| 4,155,386 | 5/1979 | Alessio | 269/321 CF |

FOREIGN PATENT DOCUMENTS

| | | | |
|---|---|---|---|
| 791081 | 2/1958 | United Kingdom | 182/33 |

*Primary Examiner*—Reinaldo P. Machado
*Attorney, Agent, or Firm*—Brumbaugh, Graves, Donohue & Raymond

[57] ABSTRACT

In the illustrative embodiments disclosed, a novel step stool structure includes the sitting and climbing features of a traditional step stool and, in addition, a vise unit affording a vise action and a working surface for carpentry or other tasks. The vise unit comprises a pair of relatively movable vise beams, the upper surfaces of which provide the working surface. One or more movable seat-forming members, by themselves or in conjunction with the vise beams, provide a seat for use of the stool in the traditional step stool sense. Movement of the movable member or members allows conversion of the stool from a seat mode of use to a workbench mode of use and vice versa.

29 Claims, 11 Drawing Figures

STOOLS

BACKGROUND

1. Field of the Invention

The present invention relates in general to stools, and more particularly to stools having top structures which can be interchangeably converted from a seat unit to a vise unit for carpentry and the like. The invention has particular, but not exclusive, application to step stools.

2. The Prior Art

Several designs of step stools are already known, and are often found in kitchens. Typically, the step stool provides a seating surface, which is usually cushioned, and a flight of steps, usually comprising one or two treads, so that it is convenient to climb up the steps to stand on the seating surface, for example, to gain access to high cupboards. The step stool is normally collapsible in some way; for example, the whole stool may collapse to a flat form for storage, or the flight of steps may have a stowage position out of the way beneath the seating surface of the stool. Representative stools of the former type are disclosed in U.S. Pat. Nos. 3,011,585; 3,227,243 and Des. 236,244, while an example of the latter type is found in U.S. Pat. No. 3,042,139.

Portable workbenches are also already known, as illustrated, for example, by U.S. Pat. No. 3,615,087 and British patent No. 1,422,521. The workbenches illustrated in these patents each provide a working surface in the form of two wooden vise beams, one of which can be moved towards and away from the other to allow a workpiece to be clamped. Each workbench is collapsible for storage purposes, since unless it is being used in an area which is devoted exclusively to work which requires such a workbench, it will be necessary to put the bench away when work has been completed, and get it out again if and when further work is done. This is fairly satisfactory if a reasonable amount of work is to be done in one session, but it is inconvenient and troublesome to get out the workbench when all that is needed is to make one sawcut, for example. As a result, there is a tendency to try to do such small jobs on makeshift benches such as kitchen stools, which are not readily suited for this purpose.

SUMMARY

It is an object of the invention, therefore, to provide a step stool which fulfills the traditional seating and climbing functions of a step stool and which also provides a readily accessible vise unit and work surface suitable for many handyman-type tasks.

It is a further object of the invention to provide a step stool of the foregoing type which includes a top structure capable of being easily and quickly converted from a seat-unit mode of use to a vise-unit mode of use and vice versa.

Still a further object of the invention is to combine both a vise unit capability and a seating/climbing capability in a single step stool structure in an economical and practical manner and in a manner which facilitates ready and safe use of both capabilities.

The foregoing and other objects are attained, in accordance with the invention, by the provision in a step stool, having a supporting structure including at least one step and a top structure including a seat, of a vise unit which affords, in the vise-unit mode of use of the top structure, a working surface in the form of two vise members of which at least one is movable towards and away from the other to provide a workpiece clamping gap between the members. The top structure also includes a provision for converting to and from the seat-unit mode of use and the vise-unit mode of use, and this in general may comprise a capability for moving a portion of all of the seat-forming surface out of its normal seat-forming position so as to leave or position the vise members accessible for use. Upon restoration of the movable portion of the seat-forming surface to its normal position, the top structure is once again useful as a traditional step stool top for sitting or standing purposes.

In perhaps its simplest form, the movable seat-forming portion may comprise a separate removable member for filling the gap between the vise members. The filler member may be a loose part, in which case it may be held in place by being clamped between the vise members, or it may be pivotally attached to the structure by some means such as a hinge or a strap, so that it can be moved out of the clamping gap when required without fear of misplacement. By ensuring that the filler member cannot be lost, there is less change that the step stool will be used as a step-ladder without the filler member in position; it will be appreciated that the working surface is safer to stand on if the clamping gap is filled. Also, when the filler member is in place, its upper surface and the upper surfaces of the adjoining vise members may constitute the seating and/or standing surface of the step stool. This has obvious economic advantages in that only one additional piece, the filler member, is required to provide the seat unit. It also facilitates quick conversion of the top structure between the two modes of use. In another form, two separate filler members could be used, one hinged to each vise member for movement into and out of the gap between the vise members. The two filler members might actually also function as part of the vise unit by being arranged to fold back on top of the adjacent vise members to which they are hinged. The undersurfaces of the filler members would then actually form the working surface of the vise unit when in the vise-unit mode of use.

Alternatively, the movable seat-forming portion may constitute a separate member of a size to overlie the entire area bounded by the vise members. The member may be used in addition to or in place of a filler piece, in the latter instance the member preferably having sufficient rigidity to bridge any gap between the vise members. If desired, this member may also be attached to the top structure by a hinge or strap as a precaution against misplacement. Where an upholstered or cushioned seat is desired, a cushion may be placed over the working surface. This may take the form of an independent member in addition to the foregoing rigid member, and may itself be separately movable between a use position covering the top structure and a non-use position removed from the top structure. Alternatively, the cushion may simply be attached to the upper side of the rigid member. As still a further possibility, the cushion could be attached to the underside of the vise unit, with the vise unit then being constructed so as to be turned over on the top structure when use of the vise unit is desired. If a separate cushion member is provided, it too is preferably attached to the top structure to guard against loss.

As a further feature of the invention, the movable seat-forming portion, whether it be one or two filler members, a rigid cover member, an independent cushioned member, or a combination of some or all of such members, is preferably attached to the top structure such that, when moved out of its seat-forming position, it blocks access to one or more of the steps of the step stool. This feature has the important advantage of impeding a user from attempting to climb onto the top structure of the stool while the top structure is in the vise-unit mode of use. As such, it represents a significant safety measure against unwitting or careless use of the step stool.

Preferably, the upper surfaces of the vise members are flat and are in substantially the same plane, at least when in the vise-unit mode of use, so as to provide a substantially planar working surface. The upper surface of the filler member may then advantageously also be made to lie in the plane of the vise member surfaces when the filler member is in the seat-forming position between the vise members, thereby affording a flat, unobstructed seating and standing surface. If desired, spaced bores can be provided through the upper surfaces of the vise members to receive rotatable, workpiece-engaging abutment members. Such abutment members facilitate the gripping of irregularly-shaped workpieces, particularly where, as they preferably are, the vise members are angularly adjustable relative to one another. Convenient storage for the abutment members when not in use or when the top structure is in the seat-unit mode may be readily provided by forming a member of bores in the lower surface or underside of the filler member.

It is believed that step stools constructed in accordance with the invention, which are in effect combined step stools and workbenches, will provide a convenient solution of the problem of holding workpieces for operations which do not justify getting out a larger workbench. Because a step stool is usually left ready for use as a seat, it is equally ready for immediate use as a workbench. The size of the working surface of the stool is, of course, limited to the normal size of the seating surface of a stool, which might be rectangular, with each side of the rectangle lying between 10 inches and 18 inches; for example, a typical size might be 15 inches by 11 inches. Thus it is not possible to work on really large workpieces, but often it is precisely with the smaller workpieces that there is a temptation to use unsatisfactory makeshift workbenches. Although most step stools are comparatively light, the existence of the steps provides a foot surface on which the user can apply his weight to stabilize the stool when carpentry or similar operations are being performed on the working surface. Thus the traditional step feature of the step stool is also useful with and complements the vise-unit function of the invention.

BRIEF DESCRIPTION OF THE DRAWINGS

For a better understanding of the invention, reference may be made to the following description of exemplary embodiments thereof, taken in conjunction with the figures of the accompanying drawings in which.

DESCRIPTION OF EXEMPLARY EMBODIMENTS

Figure 1:
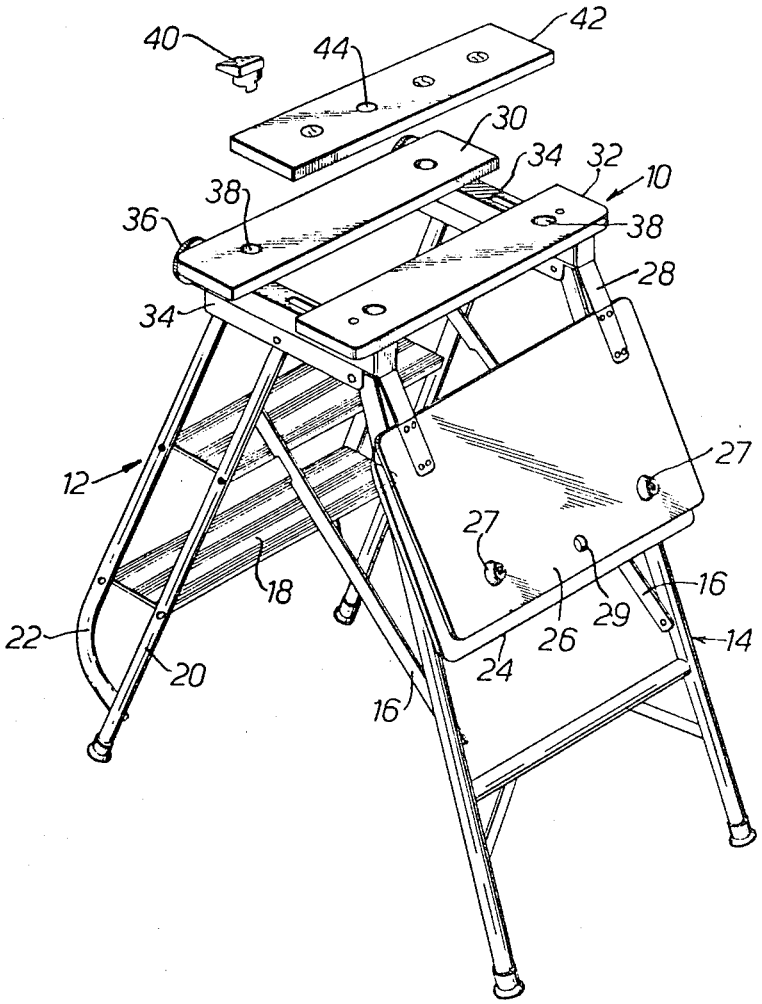
FIG. 1 is a perspective view of a first embodiment of a step stool constructed in accordance with the invention, illustrating by juxtaposition of a removable filler member above the gap between the vise beams how the top structure may readily be converted to and from the seat-unit mode of use and the vise-unit mode of use.

It should be noted preliminarily that although the step stools illustrated and described herein have only a seat surface, it will be understood that the invention also has application to step stools that include seat backs or other appurtenant structures as well as seat surfaces.

As depicted in FIGS. 1 to 5, one embodiment of a combined step stool and workbench includes a top structure 10, a front leg and step assembly 12, a rear leg assembly 14, and two struts 16 which interconnect the leg assemblies 12 and 14. The leg assemblies 12 and 14 are connected to the top structure 10 for pivoting about horizontal parallel axes, while the struts 16 are pivoted at opposite ends to the front and rear leg assemblies. The distances between the various pivot points are so selected that the stool may be collapsed to a storage position (FIG. 4) in which the two leg assemblies 12 and 14 lie generally parallel to one another, to the top structure 10 and to the struts 16, by pivoting the rear part of the top structure 10 towards the front leg and step assembly 12 from the erected position shown in FIG. 1.

As can be seen from the drawings, the rear leg assembly 14 consists simply of a pair of tubular legs interconnected by a tubular cross member, whereas the front leg and step assembly 12 consists of two side frames each consisting of two tubes 20 and 22, which run parallel for much of their length but are interconnected at their ends, and two treads 18 which extend between the side frames. The pivotal connections between the assembly 12 and the top structure 10 lie in the plane of the rear tubes 20 of the front leg assembly 12, while the front tubes 22 are so shaped at their top ends that they abut against the underside of the top structure 10 when the stool is in its erected position, thereby limiting pivoting movement of the top structure 10 away from the front leg assembly 12, so that the stool will remain in its erected position simply by gravity, without any latches or the like.

The foldable base or supporting structure as described so far is fairly conventional and provides a stool which is collapsible, and which can also be used as a small step-ladder. The specific base described is of course intended to be merely illustrative, and generally any suitable base structure may be employed. Preferably the base structure will include at least one step for use as a stabilizing member when the vise-unit mode of use is employed.

Figure 2:
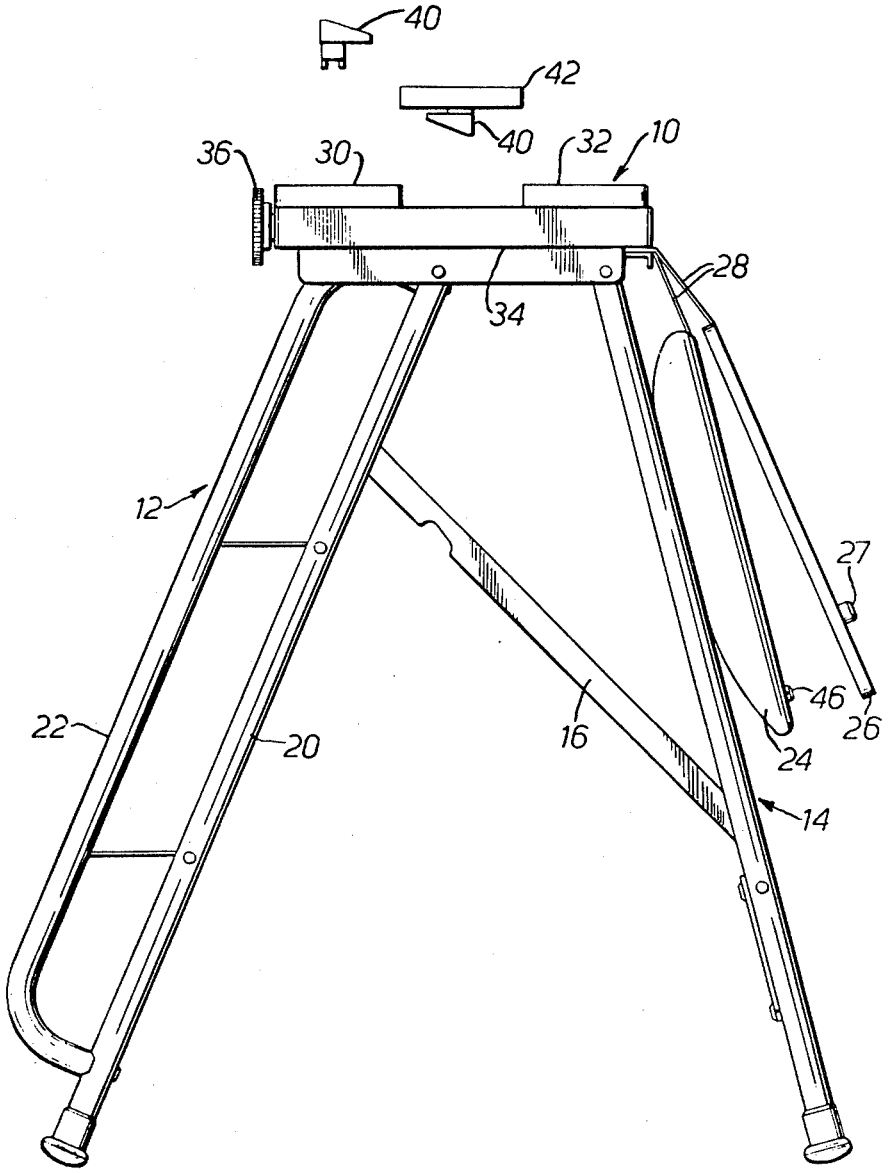
FIG. 2 is a side elevation of the step stool of FIG. 1.
Figure 3:
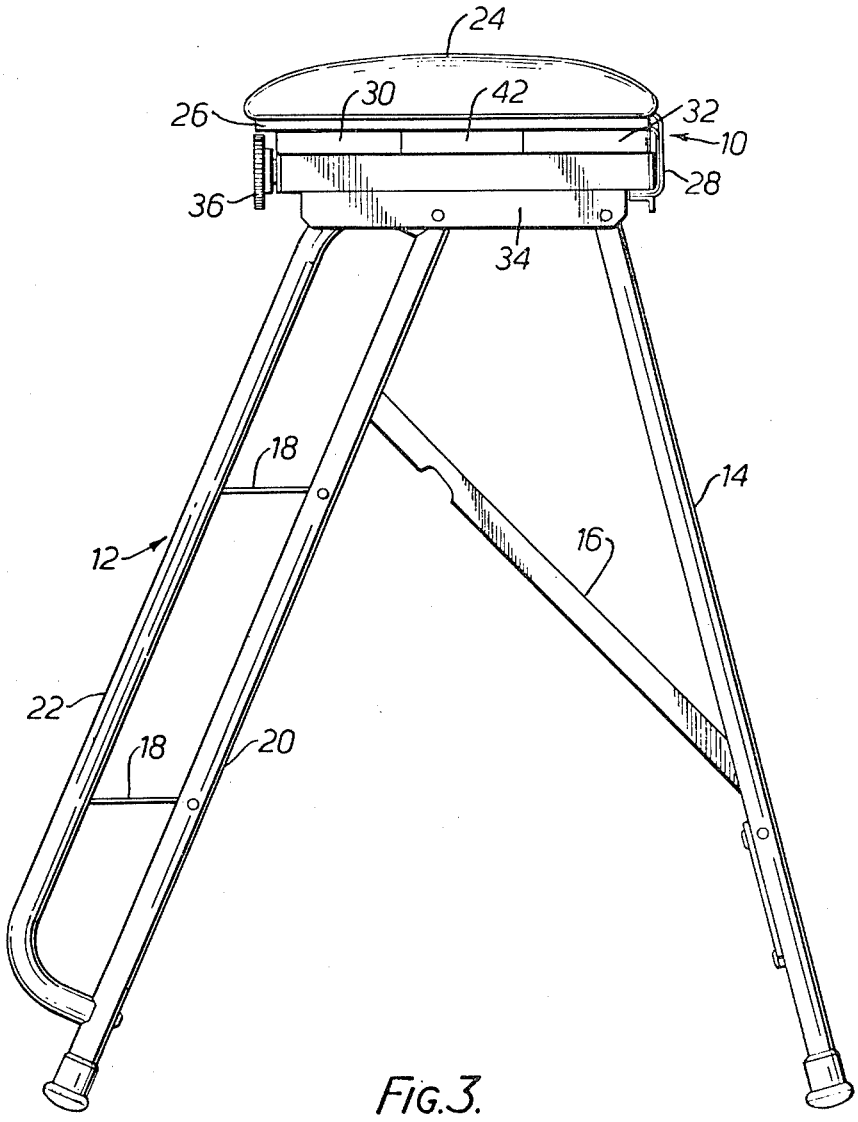
FIG. 3 is a view similar to FIG. 2, but showing the step stool in the seat-unit mode of use.

The top structure 10 will now be described in greater detail. As can be best seen in FIGS. 1 to 3 and 5, the top structure includes a soft cushioned member 24, which is shown as incorporating on its underside a rigid base, such as plywood, although this is not essential. The top structure may also include a separate board 26, also suitably of plywood, which lies beneath the cushioned member 24 when the step stool is in use as a stool, as shown in FIG. 3. Both the cushioned member 24 and the board 26 are hinged to the rear of the top structure by straps 28. FIGS. 1 and 2 show the appearance of the step stool when the cushioned member and the board are both lifted off the rest of the top structure 10, so that they hang down at the rear of the step stool. It will be seen that the top structure then affords access to a vise-unit of the same general type as that disclosed in U.S. Pat. No. 3,615,087. That is to say, the vise unit includes two vise members or beams 30 and 32, the former of which is rigidly attached near its ends to two underlying transverse supports 34. The other beam 32, however, is mounted on the transverse supports for movement therealong in the transverse direction towards and away from the fixed beam 30 to enable gripping of a workpiece between the beams. Movement of the beam 32 in this manner is accomplished through rotation of the knurled handles 36, as is described more fully hereinafter. The upper surfaces of the beams suitably are flat and lie in substantially the same plane, so as to provide a substantially planar working surface on which carpentry and other tasks can be carried out. The transverse supports 34 lie underneath the two vise beams 30 and 32, and, together with the fixed beam 30, constitute the whole of the stationary parts of the top structure; thus, the fixed beam 30 constitutes the only rigid connection between the two transverse supports 34. Each transverse support is formed with a channel in its underside, and the appropriate legs of the front and rear leg assemblies 12 and 14 are pivoted between the two sides of this channel. Although the step stool as so constructed is fairly light and easily handled, it nonetheless affords a stable working surface inasmuch as a user can place a foot on one of the treads 18 to stabilize the step stool while it is in use as a workbench.

Figure 5:
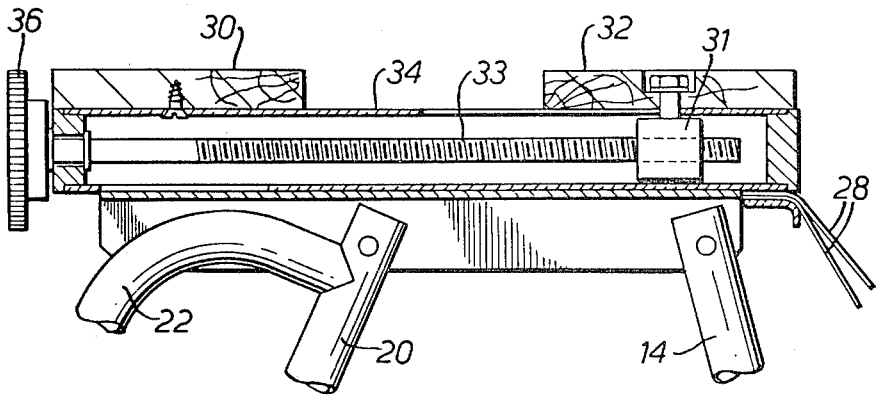
FIG. 5 is a sectional view of part of the top structure of the step stool.

FIG. 5 shows the mechanism which transmits rotation of the handles 36 to the moving vise beam 32, and this mechanism too is broadly similar to the corresponding mechanism described in the aforementioned U.S. Pat. No. 3,615,087. Thus, two vise nuts 31 are secured to the underside of the movable beam 32, one near each end thereof, in such a way that they can pivot around vertical axes. The vise nuts 31 receive vise screws 33 which lie within the transverse supports 34 and carry the handles 36 at their forward ends. The upper surfaces of the vise nuts 31 coact with the underneath surfaces of the transverse supports 34 to hold the movable beam 32 down along the supports 34 while permitting movement of the beam 32 along the supports. There is also sufficient lateral clearance between the sides of the vise nuts 31 and the sides of the transverse supports to allow the vise beam 32 to move to an angular position in the manner described more fully in U.S. Pat. No. 3,615,087. To allow this, it is also necessary for the vise screws 33 to be able to move slightly laterally, and this is achieved by journalling them in supports 34 at their front ends so that their rear ends are free to swing laterally along with the vise nuts 31.

Preferably, each of the vise beams is provided with a number of bores 38 opening through the upper surface thereof (FIG. 1), and into which pegs or abutments 40 can be inserted. As is described in British patent No. 1,422,521, the combination of such abutments with an angularly disposable vise beam, such as the rearward beam 32 herein, greatly facilitates the gripping both of wide workpieces and of irregularly shaped workpieces.

Figure 6:
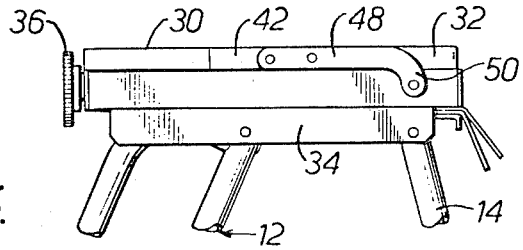
FIG. 6 is a side elevation of the top part of a modified version of the step stool of FIGS. 1 to 5.
Figure 4:
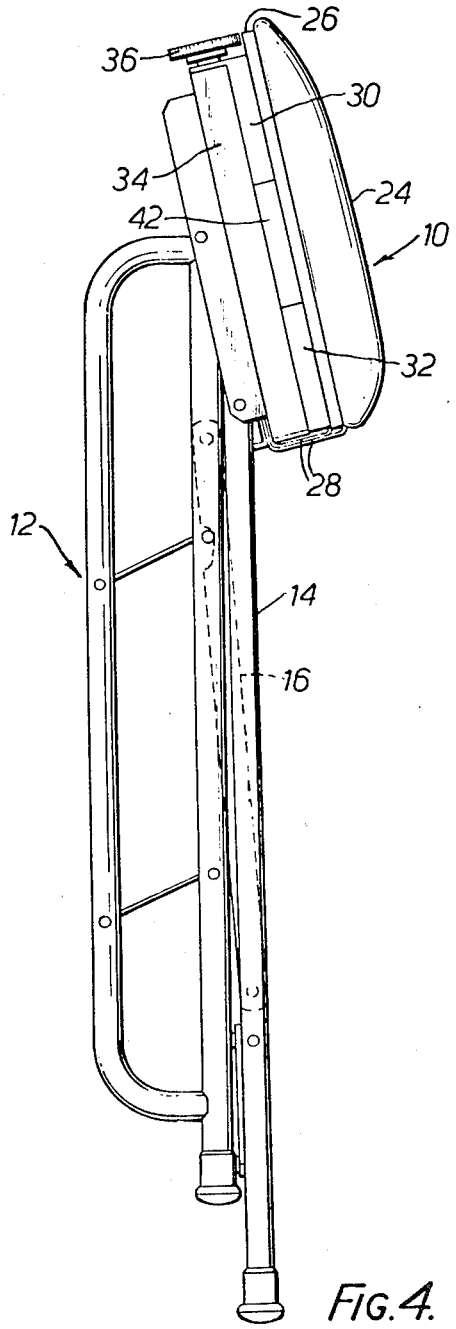
FIG. 4 is a side elevation of the step stool of FIG. 1 in a collapsed storage position.
Figure 7:
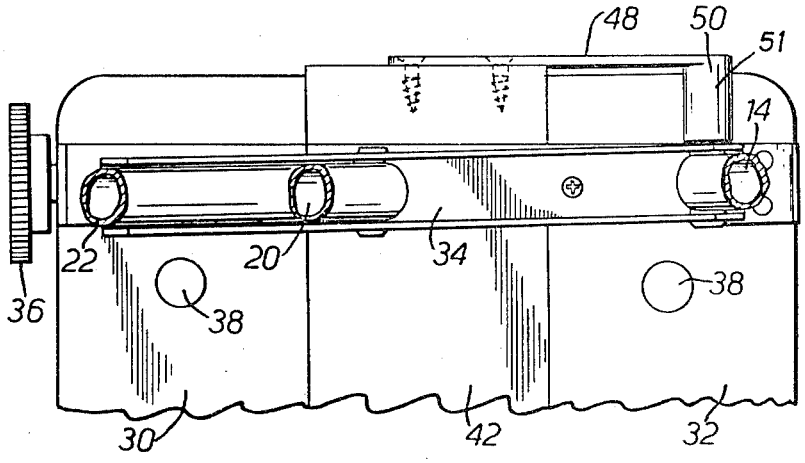
FIG. 7 is a partial underside plan view of the top part of the modified step stool of FIG. 6.

When it is desired to use the step stool in its traditional sense, i.e. to sit or stand upon it, the vise-unit structures depicted in FIGS. 1 to 5 may be readily converted to a seat-unit structure by inserting a removable filler piece 42 in the gap between the beams 30 and 32 and clamping it in place by turning the handles 36. The filler piece 42 may be either completely separate from the top structure, as illustrated in FIGS. 1 and 2, or it may be attached in pivotal fashion to the top structure, as illustrated in FIGS. 6 and 7. As there shown, the filler piece 42 has a hinge plate 48 attached to each of its end faces by two woodscrews. The hinge plates 48 extend towards the rear of the stool, with a small clearance at each end of the moving vise beam 32, and each has a downwardly directed portion 50 which is pivoted on a hinge pin projecting laterally from the corresponding transverse support 34, below the moving vise beam 32. The small clearance from the end of the beam 32 can be provided either by forming an offset in the hinge plate 48, or by making the filler piece 42 slightly longer than the beam 32. A spacer 51 is provided on the hinge pin between the transverse support 34 and the hinge plate 48, since the ends of the vise beams 30 and 32 and of the filler piece 42 overhang the transverse supports 34. With this arrangement, the filler piece 42 can be hinged into and out of position. When not in use, it hangs down at the rear of the step stool out of seat-forming relation to the stool. It will also be seen that it is not necessary to clamp the filler piece between the vise beams to ensure that it does not fall out of place. For a simpler construction, while still retaining the advantage of avoiding misplacement of the filler piece 42 when not in use, the filler piece could be attached to the top structure by a strap or the like.

In another embodiment, a second filler piece (not shown) could be hinged to the top structure and pivoted forwardly over the front beam when not in use. As pointed out later in connection with the embodiment of FIGS. 10 and 11, such a forwardly-hinged member could also serve as a safety device by being arranged to impede access to the top structure when the stool is in the vise-unit mode. A user would of course not be likely to attempt to climb onto or sit on the top structure so long as the filler member was positioned across the front of the stool. A like advantage could be obtained with only the single filler piece 42 by connecting it to the top structure for forward pivoting, rather than rearward pivoting as shown in FIGS. 6 and 7.

Other constructions utilizing a filler piece or member may also be employed. For example, two filler pieces could be provided between the vise beams 30 and 32, with each piece being hinged directly to the facing edge of the adjacent beam for folding back on top of the adjacent beam when not in use as a seat-forming surface. The undersides of the filler pieces would then constitute the working surface of the top structure when in the folded-back positions. The normally-upper surfaces of the filler members, and also of the vise beams 30 and 32, could then be cushioned or upholstered if desired to provided the seating surface, in lieu of the use of a separate cushioned member 24.

Returning now to FIGS. 1 and 2, the filler piece 42 is also preferably provided with a plurality of bores 44, suitably equal in number to the number of pegs 40 provided (e.g., 4), into which the pegs 40 can be inserted for storage. As shown in FIG. 2, the pegs would normally be inserted from underneath, so that they do not form an obstruction on the working or seating surface. It is alternatively possible to insert the pegs from underneath into the holes 38 for storage. It will be understood that the pegs 40 are made to have a friction fit in the holes 38 or 44, so that they will not fall out.

An uninterrupted working or seating surface can also be provided by moving the board 26 from the position shown in FIG. 2 to the position in which it lies on top of the vise beams 30 and 32. As shown, the board 26 preferably is of a size to cover the entire area bounded by the beams 30 and 32. To insure positive and safe positioning of the board on the beams, the board may carry two feet or projections 27, suitably of rubber or other resilient material, which engage with the bores 38 in the forward beam 30. Additional projections (not shown) may likewise be provided if desired for engagement with the bores in the rearward beam 32. Optionally, a member such as the filler piece 42 could be fastened to the bottom of the board 26 and clamped between the beams 30 and 32 to locate the board in place over the beams.

When there is a need for a stool with a cushioned top, the cushioned member 24 may be moved to lie on top of the board 26, as shown in FIG. 3. To that end, the board 26 is formed with a hole 29 which cooperates with a projection 46 (see FIG. 2) on the underside of the cushioned member 24, to locate the cushioned member in the same way as the board 26 is located by the feet 27 on its underside.

It will be understood that it is not strictly necessary to provide both the filler piece 42 and the board 26, since either of these components on its own will allow an uninterrupted working surface to be provided. The board 26 has the advantage, however, of providing a surface free of any bores or cracks between members such as are present in and between the beams 30 and 32 and the filler piece 42. Also, the board may be more readily fabricated from decorative materials, such as plastics or the like, than the beams 30 and 32, which also must function as vise jaws.

If there is no need for an uninterrupted hard working or seating surface, and it is considered acceptable for a user to stand on the cusioned member 24 when the stool is in use as a step stool, both the filler piece 42 and the board 26 can be dispensed with, provided that the cushioned member 24 incorporates a rigid bearing surface on the underside thereof that is strong enough to bridge the gap between the two vise beams 30 and 32. Conversely, if there is no need for a cushioned surface, the cushioned member 24 can be dispensed with, leaving the filler piece 42 and/or the board 26 to complete the seat surface. As with the previously described arrangements, the filler piece 42 or board 26 may be loose or hinged.

Although in all the arrangements so far described, the cushioned member 24 is hinged to the top structure 10, it is also possible to make this cushion bodily removable. This may be particularly helpful if the seat cushion has attached to it an upstanding seat back. As the seat back would normally be attached to the rear edge of the cushioned member 24, which is the edge hinged to the rest of the top structure, the seat back could obstruct pivoting of the seat cushion to the position shown in FIG. 2. In an alternative construction employing a bodily removable cushioned member 24, the cushioned member 24 could be attached to the underside of the transverse supports 34 and the entire vise unit be made bodily removable. With this construction, the vise unit would simply be flipped over on the top structure to convert from a seat mode of use to a vise mode of use and vice versa. In such case, the stool base structure would be attached to an underlying support for the vise unit and not directly to the transverse supports themselves.

It is also possible for any of the constructions described above to incorporate a cushioned member which has a deep skirt around its edge. Such a skirt would locate around the outside of the vise beams 30 and 32, and would conceal the handles 36 when the step-stool is not being used as a workbench.

Figure 8:
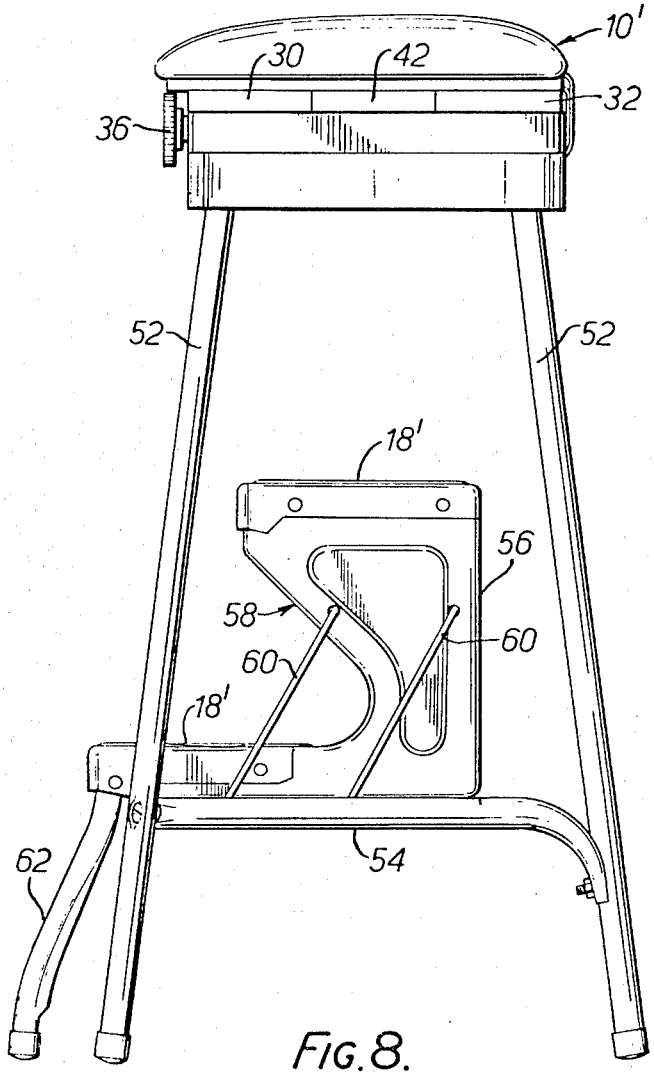
FIG. 8 is a side elevation of another form of step stool embodying the invention, in position for use as a stool.
Figure 9:
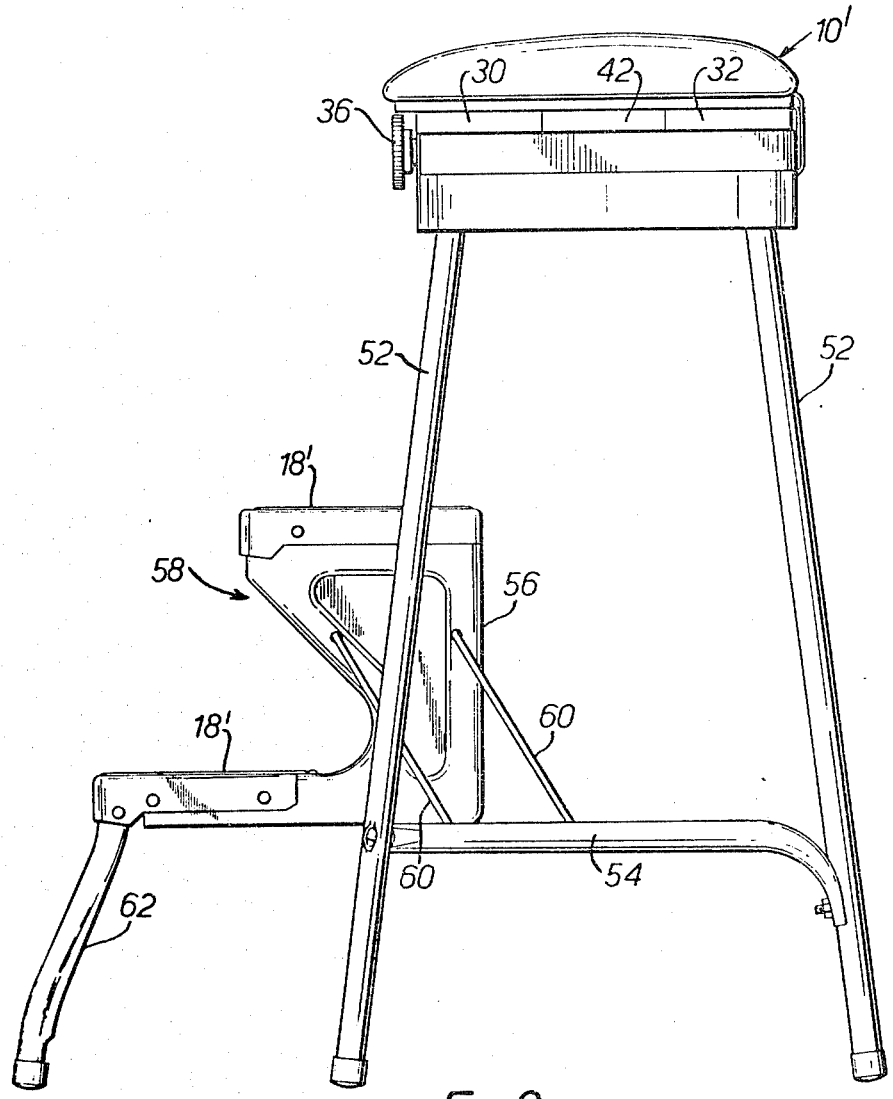
FIG. 9 is a view similar to FIG. 8, but showing the step stool in position for use as a step-ladder.

A further embodiment of the combined step stool-workbench of the invention, illustrating use of a different base structure, is shown in FIGS. 8 and 9. The top structure 10' thereof is basically similar to FIGS. 1 to 5, and like parts thereof are identified with like reference numbers. The base structure includes four tubular legs 52 extending downwards from the corners of the top structure. The legs are interconnected by a tubular strut 54, which is the preferred form is a generally U-shaped member that is connected at its closed end to the front legs of the base and at its open end to the rear legs of the base. Unlike the step stool of FIGS. 1 to 5, the structure as so far described is not collapsible for storage. The step stool of FIGS. 8 and 9 also includes two treads 18' which are interconnected by two side frames 56 to form a rigid sub-unit 58. This sub-unit is connected to the main structure of the stool by two parallel links 60 at each side, these links being pivoted at their lower ends to portions of the strut 54 interconnecting the front and rear legs 52 and at their upper ends to the side frames 56 to form a pair of parallelogram linkages. To ensure that the two linkages move in synchronism, the corresponding links on opposite sides of the sub-unit 58 are in fact formed from a single piece metal rod, so that the central part of the rod extends across the width of the sub-unit 58, beneath the upper tread 18'.

The sub-unit 58 is therefore movable in an arcuate path, first rising and then falling, between a retracted position in which it lies completely beneath the stool (FIG. 8) and an operative position in which the stool can be used as a small step ladder (FIG. 9). The parts of the step stool are so dimensioned that this movement of the sub-unit is limited, at both ends, by the engagement of legs 62, which form part of the sub-unit 58, against the floor, and by engagement of the sub-unit 58 against the top of the portion of the strut 54 interconnecting the two front legs 52. Thus, as with the embodiment of FIGS. 1 to 5, the user's weight can be applied to one of the treads 18' when the stool is in use as a workbench, and will act on the front strut 54 to hold the complete stool down on the floor.

Figure 10:
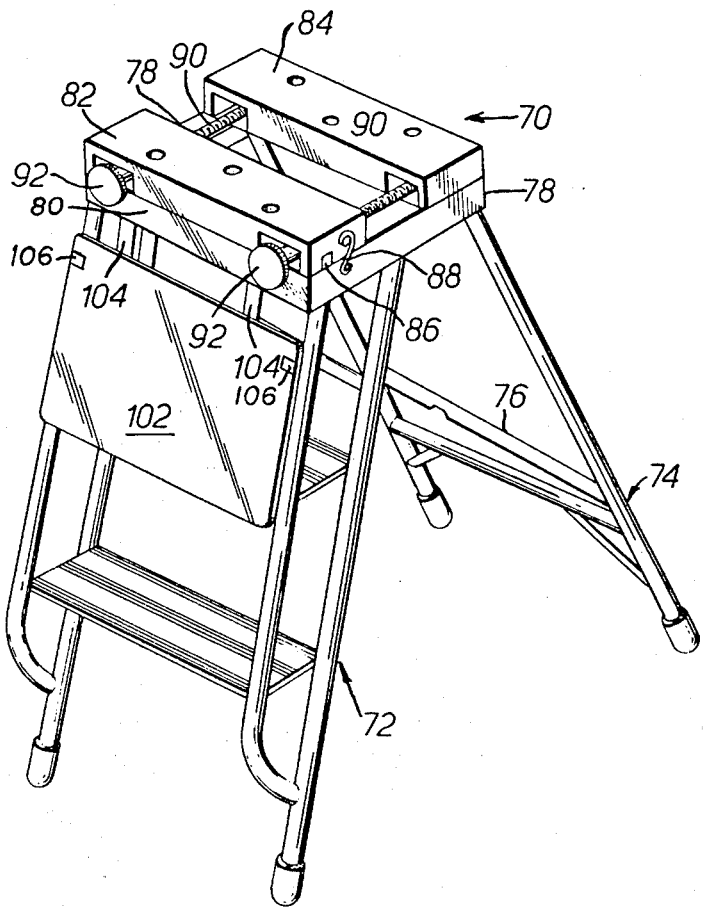
FIG. 10 is a perspective view of still another embodiment of the invention.
Figure 11:
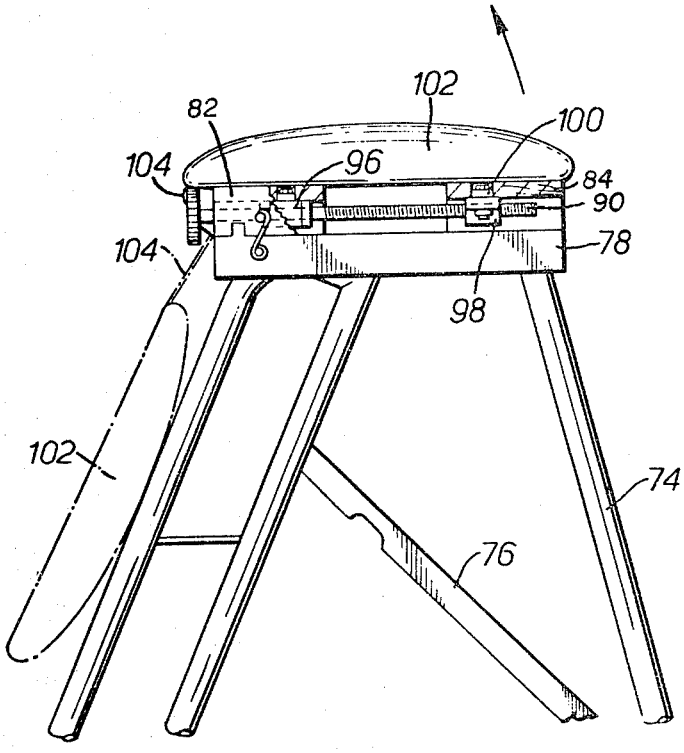
FIG. 11 is a partial side elevational view of the embodiment of FIG. 10.

Still a further embodiment of the invention is shown in FIGS. 10 and 11. In this embodiment, the construction is basically similar to that of FIG. 1 in that it includes a top structure 70, a front leg and step assembly 72, a rear leg assembly 74 and two struts 76 which interconnect the leg assemblies 72 and 74. As with FIG. 1, the leg assemblies 72 and 74 are connected to the top structure 70 for pivoting about horizontal parallel axes while the struts 76 are pivoted at each end to the front and rear leg assemblies. The stool may be collapsed to a storage position similar to that of FIG. 4 in which the two leg assemblies lie generally parallel to one another and to the top structure and the struts.

The top structure 70 includes an underlying supporting structure comprising a pair of transverse rails 78, a front rail 80 and a rear rail (not shown). This supporting structure carries a pair of vise beams 82 and 84, of which the front vise beam 82 remains stationary and is located on the front rail 80 by upwardly extending projections 86 that are received in mating recesses in the beam. The front beam 82 is held down on the rail 80 by a pair of latches 88 that hook over studs on the beam 82 and transverse rails 78. The rear vise beam 84 can be drawn towards the front vise beam 82 by a pair of vise screws 90 having operating handles 92 at their forward ends. As shown in FIG. 11, the vise screws are each journalled within the front vise beam 82 by means of a sleeve 96 that is secured to the underside of the vise beam 82 and against which the screw 90 is restrained against axial movement. At its free end, each screw 90 passes through a nut 98 within the rear vise beam 84, the nut being connected to the underside of the rear vise beam 84 by a vertical pivotal connection 100. As described more fully in U.S. Pat. No. 3,615,087, this enables independent operation of the two vise screws, for example, by rotation of one vise screw without rotation of the other, to permit positioning of the rear vise beam at an angle to the front vise beam.

The stool is completed by a cushioned member 102 which is connected to the front rail 80 by a pair of straps 104 so that the member can be folded in front of the vise screws and across the front of the upper step. As noted previously, this is a significant safety feature which serves to prevent the user from mounting the steps and the vise beams when the cushion is removed. Preferably the cushioned member blocks only the upper step, leaving the lower step free for use as a stabilizing member on which a user may exert his weight when using the stool in the vise-unit mode.

By releasing the latches 88, the two vise beams, together with their clamping screws, can be removed as a unit to form a loose clamp. The stool can still be used in such instance in its traditional sense by replacing the cushioned member 102 on top of the rails 78, 80, etc. For this purpose, the cushioned member may be provided with recesses 106 (FIG. 10) in the underside thereof to mate with the projections 86 on the front rail 80 and thereby positively locate the cushioned member on the stool top structure.

Although the invention has been described with reference to specific embodiments thereof, many modifications and variations of such embodiments may be made by one skilled in the art without departing from the inventive concepts embodied therein. All such modifications and variations, therefore, are intended to be included within the spirit and scope of the appended claims.

We claim:

1. In a combined step stool and vise unit having a supporting structure including at least one step and a top structure supported thereon, the improvement comprising:

means for providing a vise-unit mode of use of said top structure, said means including (1) first and second elongate members having opposed elongate edges, said elongate members providing an upwardly facing working surface at least when said top structure is in said vise-unit mode of use, and (2) means for urging said elongate members transversely towards and away from each other so as to permit gripping of a workpiece therebetween at least when said top structure is in said vise-unit mode of use; and means for providing a seat-unit mode of use of said top structure, said means including (1) means for normally defining an upwardly facing, substantially continuous, seat-forming surface when said top structure is in said seat-unit mode of use and (2) means for permitting movement of at least a part of said seat-forming surface out of seat-forming relation to said supporting structure for permitting conversion of said top structure from said seat-unit mode of use to said vise-unit mode of use.

2. The combined step stool and vise unit of claim 1 wherein said means for permitting movement of at least a part of said seat-forming surface comprises a third elongate member adapted to be gripped between said first and second elongate members, the upper surface of said third member when so gripped defining at least a part of said seat-forming surface.

3. The combined step stool and vise unit of claim 2 wherein the upper surfaces of said first, second and third elongate members, when said third member is gripped between said first and second elongate members, lie in substantially the same plane and together define said seat-forming surface.

4. The combined step stool and vise unit of claim 2 wherein said movement permitting means further comprises means pivotally attaching said third elongate member to said top structure for movement between the seat-forming position in which it is adapted to be gripped between said first and second elongate members and a position in which it is out of seat-forming relation to said supporting structure.

5. The combined step stool and vise unit of claim 1 wherein the upper surfaces of said elongate members lie in substantially the same plane and together form a substantially flat working surface when said top structure is in said vise-unit mode of use.

6. The combined step stool and vise unit of claim 1 wherein:

said seat-surface forming means comprises a member which, in the seat-unit mode of the top structure, overlies and covers substantially the entire area bounded by the first and second elongate members; and said means for permitting movement of at least a part of said seat-forming surface comprises means for permitting movement of said third member out of said overlying relationship to said elongate members.

7. The combined step stool and vise unit of claim 6 wherein the upper surface of said third member, as viewed in the seat-unit mode of use of the top structure, is a resilient cushioned surface and the lower surface of said third member, as so viewed, is a rigid bearing surface for bridging any gap between the first and second elongate members.

8. The combined step stool and vise unit of claim 1 further comprising releasable means for permitting said first and second elongate members and said urging means to be removed from said top structure as a unit for use as a separate vise unit.

9. The combined step stool and vise unit of claim 1 wherein:

said seat-surface forming means comprises (1) a third rigid member which, in the seat-unit mode of use of the top structure, overlies the first and second elongate members and bridges any gap therebetween and (2) a fourth cushioned member which, in the seat-unit mode of use of the top structure, overlies said third rigid member and forms said seating surface; and said means for permitting movement of at least a part of said seat-forming surface comprises means for permitting movement of said third and fourth members out of overlying relationship to said first and second elongate members.

10. The combined step stool and vise unit of claim 9 wherein said movement permitting means includes means for separately pivotally attaching said third and fourth members to said top structure for independent movement thereof out of and into said overlying relationships.

11. In a combined step stool and vise unit including a supporting structure having at least one step and a top structure incorporating a seat on which a user may sit or stand, the improvement comprising:

means for interchangeably converting said top structure from a seat to a vise unit, said converting means including (1) a pair of vise members having opposed clamping surfaces and operating means for urging said vise members relatively together and apart to provide a gripping action between the clamping surfaces thereof and (2) at least one additional member movable relative to said vise members between a first position, in which said top structure forms a seat and said at least one member forms at least a part thereof, and a second position, in which said at least one member is moved out of seat-forming relation to said vise members and said vise members and operating means are available for use as a vise unit.

12. The combined step stool and vise unit of claim 11 wherein said at least one additional member is attached to said top structure for pivotal movement between said first and second positions.

13. The combined step stool and vise unit 11 wherein the upper surface of said at least one additional member, in the first position thereof, forms said seat together with the upper surfaces of said pair of vise members.

14. The combined step stool and vise unit of claim 11 wherein the upper surfaces of said vise members lie in substantially the same plane to provide a substantially planar working surface when said at least one additional member is in said second position and said vise members and operating means are available for use as a vise unit.

15. The combined step stool and vise unit of claim 14 wherein the upper surface of said at least one additional member, when said additional member is in said first position, lies in substantially the same plane as the plane of the upper surfaces of said vise members, thereby providing together with said vise members a substantially planar seat.

16. The combined step stool and vise unit of claim 11 wherein:

each of said vise members includes a plurality of spaced bores opening through the upper surface thereof, each of which bores is adapted to receive in snug rotatable relation an abutment member having a workpiece engaging surface lying above the upper surface of the vise member; and said operating means includes means for selectively adjusting the angular position of one vise member relative to the other vise member so as to facilitate the gripping of irregularly shaped workpieces between the abutment members carried by the respective vise members.

17. The combined step stool and vise unit of claim 16 wherein said at least one additional member includes a plurality of spaced bores opening through the lower surface thereof for storage of said abutment members.

18. The combined step stool and vise unit of claim 11 wherein said at least one additional member, in the first position thereof, overlies and covers substantially the entire area bounded by the pair of vise members.

19. The combined step stool and vise unit of claim 11 wherein the upper surface of said at least one additional member, as viewed in the first position thereof, is a resilient cushioned surface and the lower surface thereof, as so viewed, is a rigid bearing surface for bridging any gap between the pair of vise members.

20. The combined step stool and vise unit of claim 11 wherein:

said at least one additional member comprises a rigid member which, in the first position thereof, overlies said pair of vise members and bridges any gap therebetween; and said converting means further comprises a second additional member movable between said first and second positions, said second additional member comprising a resilient cushioned member which, in the first position thereof, overlies said at least one additional member and forms said seat.

21. The combined step stool and vise unit of claim 20 wherein said converting means includes means for separately pivotally attaching said additional members to said top structure for independent movement between said first and second positions.

22. In a combined step stool and vise unit including a supporting structure having at least one step and a top structure incorporating a seat on which a user may sit or stand, the improvement in said top structure comprising:

a pair of vise members having opposed clamping surfaces;

operating means for urging said vise members relatively together and apart to provide a gripping action between the clamping surfaces thereof; and means normally forming at least part of said seat and movable between a first position, in which said movable means forms at least a part of said seat, and a second position, in which said movable means is moved out of said seat-forming position and said vise members and operating means are available for use as a vise unit.

23. The combined step stool and vise unit of claim 22 wherein the improvement in said top structure further comprises said movable seat-forming means, in the second position thereof, blocking access to at least one step of the supporting structure to impede a user from climbing onto the top structure while said movable seat-forming means is out of said seat-forming position.

24. The combined step stool and vise unit of claim 23 wherein said supporting structure includes at least two steps and wherein said movable seat-forming means, in the second position thereof, blocks access only to one or more of the higher steps while leaving the lowest step accessible to a user for exerting his weight thereon to stabilize the step stool during use of the vise unit.

25. A combined step-stool and vise unit comprising a supporting structure which includes at least one step and a top structure carried by the supporting structure, the top structure being convertible between (a) a vise mode in which the top structure affords an upwardly facing pair of side-by-side elongate vise members, the upper surfaces of which are substantially co-planar to provide a substantially flat working surface and the adjacent elongate edges of which provide clamping surfaces, the top structure including means for positively moving at least one vise member transversely relative to the other vise member to provide a clamping gap between said clamping surfaces; and (b) a seating mode in which the top structure affords an upwardly facing, substantially non-interrupted seating surface upon which a person can sit or upon which he can climb by use of said step.

26. A combined step-stool and vise unit as claimed in claim 25 in which the seating surface is provided by movable seat means having a first position, corresponding to said seating mode, in which it covers substantially the whole of said vise members and said clamping gap.

27. A combined step-stool and vise unit as claimed in claim 26, in which said seat means, when in said first position is at least partially supported by said vise members.

28. A combined step-stool and vise unit as claimed in claim 26, in which said seat means comprises a seat member which is hinged to said top structure for movement between said first position and a second position, corresponding to said vise mode, in which said vise members are uncovered.

29. A combined step-stool and vise unit as claimed in claim 28, in which said seat member, when in said second position, at least partially blocks access to at least one step of the supporting structure.

* * * * *

UNITED STATES PATENT AND TRADEMARK OFFICE

CERTIFICATE OF CORRECTION

PATENT NO. : 4,236,599

DATED : December 2, 1980

INVENTOR(S) : Brian Anthony Luff et al.

It is certified that error appears in the above—identified patent and that said Letters Patent is hereby corrected as shown below:

Column 2, line 23, "change" should read --chance--;
Column 5, line 53, "along" should read --on--;
Column 9, line 56, "In a" should read --A-- and "having" should read -- , comprising--;
Column 9, lines 58 & 59, delete ", the improvement comprising";
Column 11, line 16, "In a" should read --A-- and "including" should read -- , comprising--;
Column 11, line 19, " , the improvement comprising:" should read -- ; and--;
Column 11, line 40, after "unit" insert --of claim--;
Column 12, line 34, "In a" should read --A-- and "including" should read -- , comprising--;
Column 12, lines 37 & 38, " , the improvement in said top structure comprising:" should read -- ; and--; and
Column 12, line 52, delete "the improvement in".

Signed and Sealed this

Second Day of June 1981

[SEAL]

Attest:

RENE D. TEGTMEYER

Attesting Officer

Acting Commissioner of Patents and Trademarks